US010800986B1

(12) United States Patent
Ball, IV

(10) Patent No.: US 10,800,986 B1
(45) Date of Patent: Oct. 13, 2020

(54) PARAFFIN CONTROL UNIT

(71) Applicant: Oil Capitol NOW, LLC, Tulsa, OK (US)

(72) Inventor: Will D. Ball, IV, Bixby, OK (US)

(73) Assignee: Oil Capital NOW, LLC, Tulsa, OK (US)

( * ) Notice: Subject to any disclaimer, the term of this patent is extended or adjusted under 35 U.S.C. 154(b) by 0 days.

(21) Appl. No.: 16/288,341

(22) Filed: Feb. 28, 2019

Related U.S. Application Data

(60) Provisional application No. 62/636,596, filed on Feb. 28, 2018.

(51) Int. Cl.

| | |
|---|---|
| ***C10G 73/30*** | (2006.01) |
| ***C10G 73/34*** | (2006.01) |
| ***C10G 1/04*** | (2006.01) |
| ***C10G 9/24*** | (2006.01) |

(52) U.S. Cl.
CPC ..... *C10G 73/30* (2013.01); *C10G 1/045* (2013.01); *C10G 9/24* (2013.01); *C10G 73/34* (2013.01); *C10G 2300/1085* (2013.01)

(58) Field of Classification Search
CPC ..... C10G 73/30; C10G 9/24; C10G 1/045; C10G 73/34; C10G 2300/1085
See application file for complete search history.

(56) References Cited

U.S. PATENT DOCUMENTS

| | | | | |
|---|---|---|---|---|
| 3,708,960 | A | 1/1973 | Christopher et al. | |
| 6,199,629 | B1 | 3/2001 | Shirk et al. | |
| 7,531,099 | B1 | 5/2009 | Rhodes | |
| 7,871,526 | B2 | 1/2011 | Allouche | |
| 8,192,632 | B2 | 6/2012 | Michael et al. | |
| 8,465,572 | B1 * | 6/2013 | Ball, IV | B01D 17/042 95/253 |
| 8,470,080 | B1 | 6/2013 | Ball et al. | |
| 8,657,897 | B2 | 2/2014 | Kaya et al. | |
| 9,157,035 | B1 | 10/2015 | Ball et al. | |
| 9,222,027 | B1 * | 12/2015 | Malone | C10C 3/002 |

OTHER PUBLICATIONS

Smith, Vernon H., and Arnold, Kenneth E., Petroleum Engineering Handbook, vol. III, Facilities and Construction Engineering, Chapter 3, pp. 61-122 (Society of Petroleum Engineers 2017).

* cited by examiner

*Primary Examiner* — Randy Boyer
*Assistant Examiner* — Juan C Valencia
(74) *Attorney, Agent, or Firm* — Margaret Millikin

(57) ABSTRACT

A paraffin control unit with staged high voltage temperature controlled electric immersion heaters to maintain the paraffin component of the crude oil in the liquid phase. The paraffin control unit removes large volumes of naturally occurring fine sand from the incoming liquids while also removing the crude oil from the influent fluid stream, the natural gas from the influent fluid stream, salt water from the influent fluid stream, all while maintaining the temperature of the crude oil fraction above the cloud point of its paraffin constituent. The removed sand is collected in sand pans and is automatically removed at timed intervals. The automation assures that the accumulating sand is removed from the sand pans as rapidly as it accumulates, thus preventing an over-accumulation of sand. The process fluids flow through a coalescer and a baffle assembly which purify and separate the component phases suitable for custody transfer.

8 Claims, 5 Drawing Sheets

FIG. 1A

PARAFFIN CONTROL UNIT

CROSS-REFERENCE TO RELATED APPLICATIONS

This patent application is based on and claims priority to U.S. provisional patent application Ser. No. 62/636,596, which is entitled Paraffin Control Processor, filed Feb. 28, 2018, the entire disclosure of which is incorporated herein by reference.

TECHNICAL FIELD OF THE INVENTION

The present invention further is directed to a method for processing a petroleum stream. The method comprises the steps of receiving an influent petroleum stream; dividing the influent petroleum stream into a gas phase, an oil phase and a solid phase; transmitting electric heat energy directly into the oil phase at staged intervals as the influent petroleum stream is processed; and maintaining the temperature of the oil phase above the cloud point of any paraffin wax constituent that may be present in the influent petroleum stream.

SUMMARY OF THE INVENTION

The present invention is directed to a paraffin control unit for processing a petroleum stream. The paraffin control unit comprises a vessel having an inlet end, the inlet end adapted to receive an influent petroleum stream, wherein the vessel is adapted to separate the influent petroleum stream into component phases of gas, oil and solids, and an electric immersion heater immersed in the oil phase, whereby heat generated from the electric immersion heater is transmitted directly to the oil phase and maintains paraffin wax in solution in the oil phase.

The present invention further is directed to a method for processing a petroleum stream. The method comprises the steps of receiving an influent petroleum stream; dividing the influent petroleum stream into a gas phase, an oil phase and a solid phase; transmitting electric heat energy directly into the oil phase; and maintaining the temperature of the oil phase above the cloud point of any paraffin wax constituent that may be present in the influent petroleum stream.

DETAILED DESCRIPTION OF THE INVENTION

Figures 1, 1A:
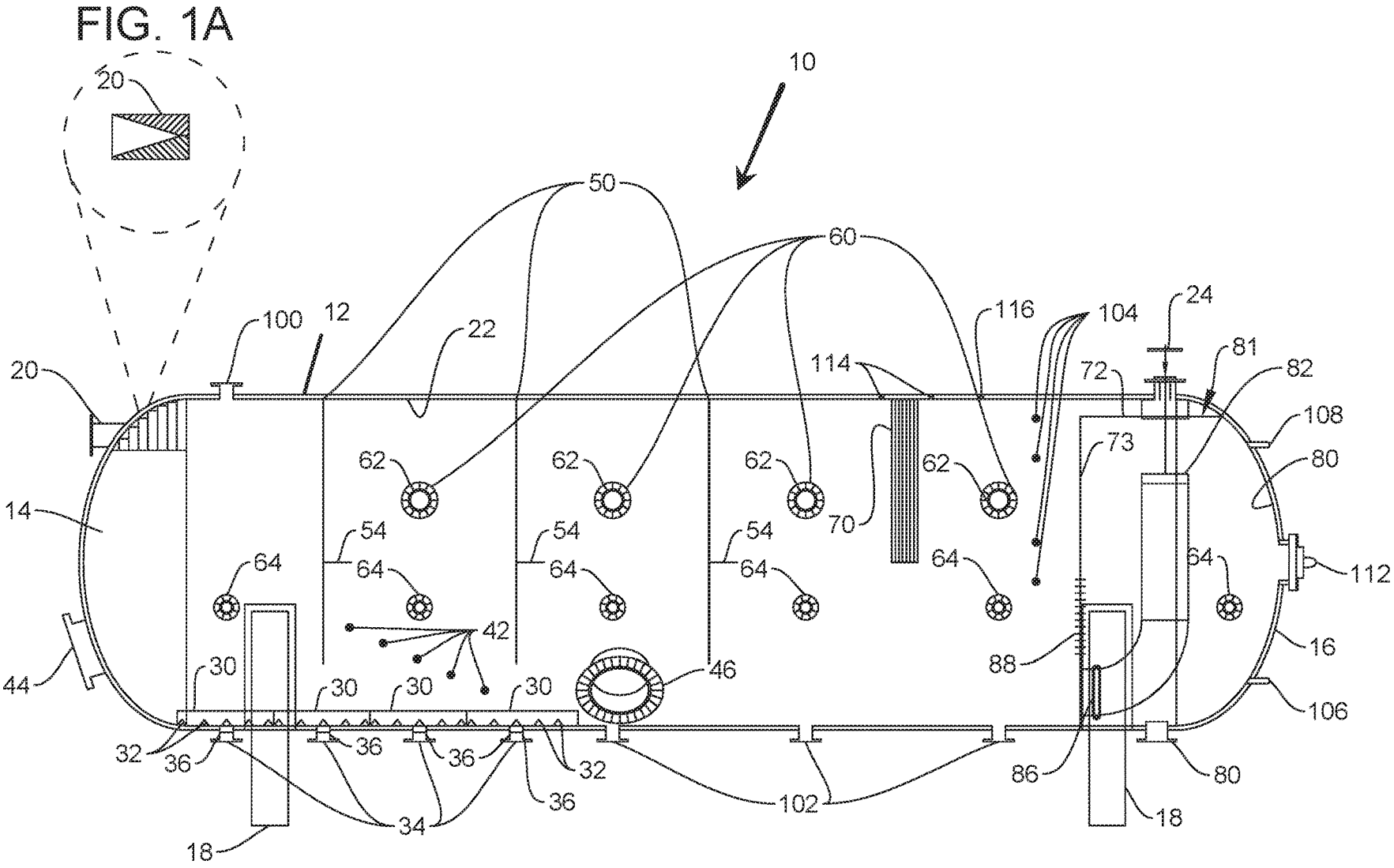
FIG. 1 is a cut away side view of an exemplar of a paraffin control unit constructed in accordance with the present invention.
FIG. 1A is an exploded view of an exemplary diverter inlet for use with the paraffin control unit of the present invention.

Heat control vessels have been used in the oil and gas industry for oil hydration or for the staged heating of crude oil. Heat control vessels, also referred to as heater treaters, are either vertical or horizontal pressure vessels which may be fitted with fire tubes.

A fire tube transfers radiant and convective heat to the surrounding process fluid. Issues pertaining to oil viscosity motivated producers and operators to add heat to lower crude oil viscosities in the vessel and enable contaminants to fall out of suspension. Early heater treaters placed the fire in the oil phase which led to disastrous fires resulting when the fire tube failed and ignited the crude oil.

Subsequent designs placed the fire tube in the water phase at or below the oil-water interface, on the erroneous assumption that a combustion could not occur in the water phase. Placement of the fire tube in the water phase causes corrosion, scale build-up, metal loss, conductive heat transfer metal failure and eventual fire tube leaks and loss.

Flame arrestor burners were added to heater treaters in an effort to mitigate the destruction by fire of these vessels and associated batteries of tanks, which reduced but did not eliminate the incidence of disastrous fires. Additionally, improved gaskets were developed to stop leaks from the fire tube into the process fluid.

These efforts, while helpful, have not completely solved the problem of fire tube failure and resultant destruction of the equipment and produced oil due to fire. Even with the fire tube located in the water phase, the water does not distinguish the burner or the pilot. Once the water leaks from the heater treater, it is followed by flammable crude oil. When crude combusts inside a flame arrestor burner, the fire melts the flame arrestor burner. The burning crude then engulfs the heater treater and any nearby facilities, typically destroying them in the process.

Furthermore, the fire tube placed in the water phase is directly heating the produced water, which requires about 2.3 times as much fuel as would be required to heat the crude oil phase. It takes approximately 350 BTU to heat one barrel of water one degree Fahrenheit (F), while requiring only about 150 BTU to heat one barrel of crude oil one degree Fahrenheit (F). Hence, heating of the water phase requires significantly more energy.

Moreover, the heating of the water phase contributes nothing to the separation of oil from water. Stokes' Law of separation teaches that calculated separation velocities must be divided by the viscosity of the continuous fluid, and the viscosity of water is essentially one centipoise from 32° F.

to 212° F. Only the oil phase viscosity is lowered by adding temperature. Thus, heating the oil phase is effective, while heating the water phase wastes energy in the pursuit of separating oil from water.

Additionally, heat transfer efficiencies of conventional heater treaters are very low. The typical heater treater is between 13% and 18% thermally efficient, which means that 82% to 87% of the fuel used in the burner is wasted. Even when mechanical adjustments are implemented to increase thermal efficiency, human error and misperceptions by operators and field personnel can contribute to the heat transfer inefficiencies in heater treaters. These errors are multiplied in their effect, particularly across systems and fields of tanks. Consequently, convention heater treaters with fire tubes and flame arrest burners still present technical difficulties, inefficiencies, and safety hazards.

The present invention solves these problems inherent in conventional heater treaters by employing electric immersion heating elements directly in the crude oil in a staged fashion. Electric immersion heating elements are thermally efficient, in that substantially all of the generated heat is transmitted directly to the process fluid. Moreover, the electric immersion heating elements can be placed directly in the oil phase with minimal risk of fire, thus enabling the crude oil phase to be heated safely, directly and efficiently. The electric immersion heaters are strategically positioned inside sealed, stainless steel enclosures so that the heating elements may be exchanged, if necessary, without shutting down the vessel and without entering the vessel.

The present invention also comprises a paraffin control unit for separating paraffin from crude in the vessel. In some oil producing regions of the world, heavier crude oil has a tight, difficult emulsion that requires heat to resolve the emulsion and meet oil pipeline specifications. Shale oil wells tend to produce 42° API to 53° API very light crude, and some produce 60° API and higher condensate. While it is necessary to chemically treat and to heat heavier crudes, the majority of today's lighter crudes do not require chemical treatment or the addition of heat. These oils are so light and their viscosities so low that even small emulsion water droplets fall out of the oil.

Some lighter crude produced today contains paraffin wax. Paraffin is an unusual constituent of crude oil in that it is soluble in crude oil as long as the crude temperature is above the cloud point, or the point at which paraffin begins to evolve out of solution. As crude oil cools, it may reach the cloud point where paraffin begins to precipitate. The paraffin forms a crystal, often nucleating, or building around, and encapsulating a solid particle, such as a particle of frac sand, formation fines, or a droplet of water. Paraffin can accumulate enough of these wax solids and/or water to trigger the reject status of a Lease Automatic Custody Transfer (LACT) unit, which measures the net volume and quality of liquid hydrocarbons, thus preventing the sale of crude with paraffin solids.

The paraffin control unit of the present invention solves the problem of paraffin precipitation and colloidal suspension in crude via the staged placement of electric immersion heating elements in the vessel for heating the crude oil. Paraffin is temperature sensitive. To prevent the issues of paraffin precipitation and off-spec crude, the electric immersion heating elements are heated to raise the temperature of the crude to slightly above the cloud point of the paraffin, which maintains the paraffin wax in solution in the crude and resolves the problem.

The present invention comprises electric immersion heating elements, with built-in thermostats so that each set of immersion heating elements can be adjusted to keep paraffin above its cloud point. By staggering or staging these heating elements throughout the oil phase in the unit, the oil temperature can be maintained above the cloud point of the paraffin, assuring complete separation and avoiding issues of off-spec oil altogether.

The present invention also efficiently removes solids, including sand, automatically, as they accumulate. Solids predictably and rapidly settle to the bottom of a heater treater and accumulate. The present invention provides an automated sand collection mechanism to assure the functional removal of sand, thus preventing an over-accumulation of sand and sand withdrawal failure.

The paraffin control unit of the present invention is the first application of staged high voltage temperature controlled electric immersion heaters in a fluids processing vessel strictly to maintain the paraffin component of the crude oil strictly in the liquid phase. Additionally, the paraffin control unit is designed with a unique combination of internal components to remove large volumes of naturally occurring fine sand from the incoming liquids while also removing 1) the crude oil from the influent fluid stream, 2) the natural gas from the influent fluid stream, 3) the disproportionately large volume of produced brackish salt water from the influent fluid stream, all while maintaining the temperature of the crude oil fraction above the cloud point of its paraffin constituent.

Figure 2:
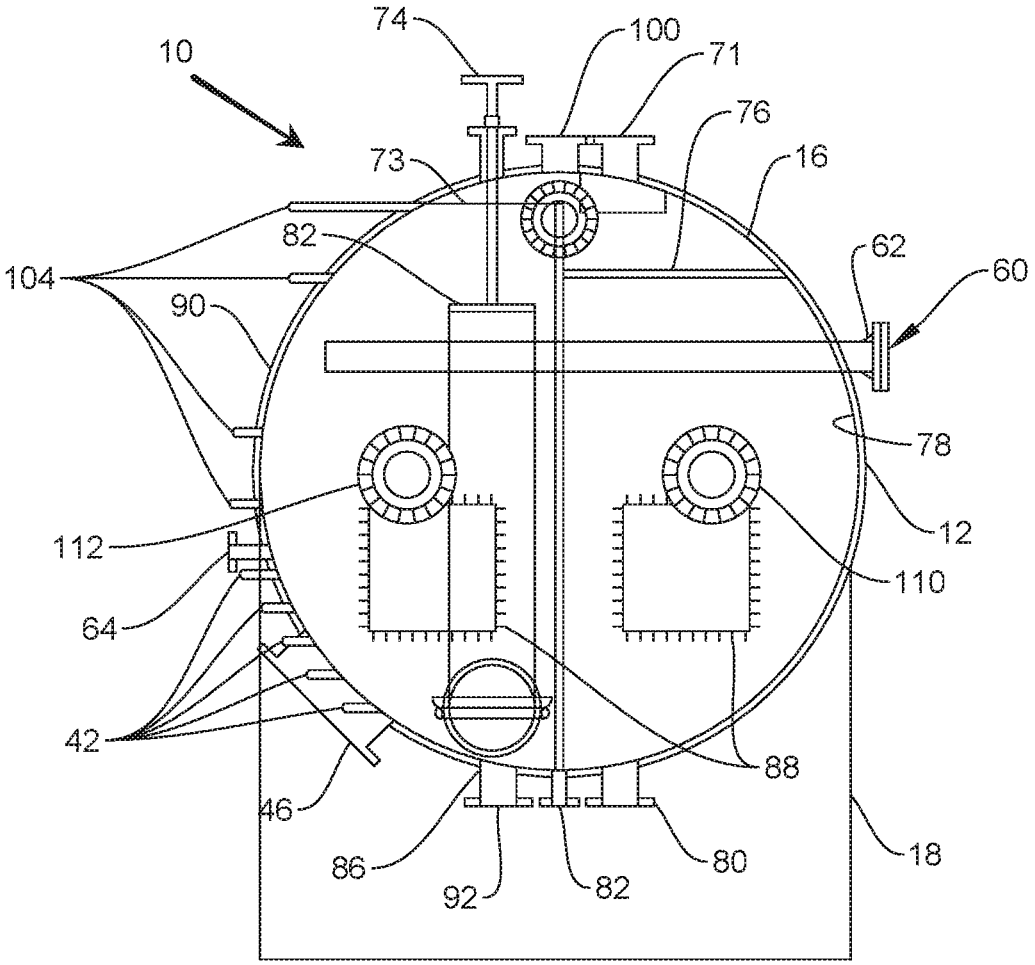
FIG. 2 is an outlet end view of the exemplar of the paraffin control unit of FIG. 1 with the redistribution baffles removed.

Turning now to the drawings in general, and to FIGS. 1 and 2 in particular, there is shown therein an exemplary paraffin control unit 10 constructed in accordance with the present invention. The paraffin control unit 10 processes an influent petroleum stream into multiple phases of fluids and solids. In one embodiment of the invention, the paraffin control unit 10 processes five phases of fluids and solids, including crude oil, natural gas, water, sand and paraffin. It will be appreciated that the paraffin control unit 10 may constructed to process fewer than five phases, or more than five phases, of fluids and solids.

The paraffin control unit 10 achieves results at low pressures and may be adapted specifically for high gravity, high water cut, high volume gas producing fluid streams processed in central process facilities in the developing shale oil operations of the oil and gas industry. The paraffin control unit 10 operates at pressures ranging from about 25 psi to about 1000, and in one embodiment of the invention, the paraffin control unit operates at pressures ranging from 25 psi to about 400 psi.

In one embodiment of the invention, the paraffin control unit 10 comprises a vessel 12 that is horizontal and generally cylindrical in shape. It will be appreciated that the vessel 12 may be vertical, or may be positioned in horizonal, diagonal or other configurations in a processing plant, refinery, wellhead, tank battery or other application, where the positioning and configuration of the paraffin control unit 10 is dependent on space and other conditions and considerations at the site where the vessel is to be used. The shape of the vessel also may take numerous shapes, including spherical, cubed, rhomboid or other configurations appropriate to the site, the application and the volume of fluids and solids to be processed.

The vessel 12 may be made be of any material suitable for use in processing solids and fluids, including steel, chrome, steel chrome-plated, steel with nickel/silicon carbide composite coating, brass, brass-chrome plated, brass with nickel/silicon carbide composite, stainless steel, stainless chrome-plated, copper, stainless with nickel/silicon carbide composite coating, carbonitrided steel, nickel carbide plated steel, tempered steel and polyvinylchloride. It will be appreciated that the vessel 12 may be produced from other materials suited to the particular temperatures, pressures, fluids, and other conditions of use.

The dimensions of the vessel 12 are variable and depend upon the volume of materials to be processed through the vessel. The length of the vessel 12 generally ranges from at least about 5 feet to at least about 60 feet. The diameter of the vessel 12 ranges from about 1 foot to about 20 feet. References herein to diameters are to inside diameters, unless specifically stated to reference an outer diameter. It will be appreciated, however, that the vessel 12 may be any diameter and length suited for conditions at for the application and site where in use. The vessel 12, and the components comprising the paraffin control unit 10, preferably, though not necessarily, comply with American Petroleum Institute (API) and/or the American National Standards Institute (ANSI) quality standards and dimensions.

The vessel 12 of paraffin control unit 10 comprises an inlet end 14 and an outlet end 16. The vessel 12 may be supported on legs or support saddles 18. The vessel 12 has an inner surface 22 which may be coated with a plastic or polymer coating to inhibit corrosion of the vessel. The influent petroleum stream, comprising a mixture of fluids and solids, upon entering the paraffin control unit 10, first encounters an inlet diverter 20.

In one embodiment of the invention, the inlet diverter 20 comprises a high efficiency inlet diverter which divides the influent stream into components, slows the velocity of each divided component of the influent stream, and directs each component toward the inner surface 22 of the vessel 12. The diverter 20 acts as a coalescer to enhance flow division of the influent petroleum streams and to enhance the overall separation process. The inlet diverter 20 may comprise a vane-type flow dividing inlet diverter as shown in FIG. 1A.

The influent flow through inlet diverter 20 often contains solids, such as sand. Produced fine sand, often 120 mesh or smaller, is quite prevalent in most high-volume shale oil produced fluid streams. Sand and other solids must be removed from the fluid streams or these solids will accumulate inside the vessel and in all process and fluid storage surface facilities, ultimately rendering them ineffective. Once the sands are separated inside the vessel 12, it is quite difficult to remove the sand solids as rapidly as they accumulate. If the sand is not removed as it accumulates, then process efficiency and storage capacity are impacted and the unit will eventually fail.

The paraffin control unit 10 of the present invention overcomes this problem by efficiently removing solids, including sand, as they accumulate. Separation of solids from fluids is rapid and predictable since the density of sand is several times heavier than that of the associated fluids in the influent stream. Sands, being heavier than liquids and natural gas, naturally settle rapidly to the bottom of the paraffin control unit 10. The settling rate is predictable using Stokes' Law.

Figure 3A:
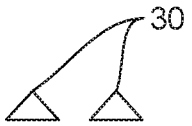
FIG. 3A is an end view of exemplar of a sand pan suitable for use in the paraffin control unit of the present invention.
Figure 3B:
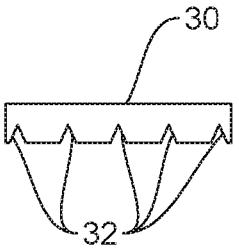
FIG. 3B is a side view of the sand pan of FIG. 3A and shows the inverted V-shaped sand jets.

Turning now to FIGS. 3A and 3B, and with continuing reference to FIGS. 1 and 2, as the sand settles, it accumulates around dedicated sand removal fixtures, or sand pans 30. The shape of the sand pans 30 may vary, and in one embodiment of the invention, each sand pan 30 comprises an elongated inverted V-shaped structure situated on the bottom of the vessel 12 proximal front end 14. Each sand pan 30 has inverted V-shaped slots cut into the sidewall of the sand pan 30 which serve as sand jets 32 and fluidize the consolidated sand layer allowing it to flow as a fluid. More than one sand pan 30 may be employed in the paraffin control unit 10. The sand pans 30 are mounted to the vessel 12 via securing means such as strap lugs, bolts, and nuts. The number of sand pans 30 employed in the paraffin control unit 10 depend upon a variety of factors, such as the size and shape of the vessel 12 and the qualities and components of the influent stream through the inlet diverter 20.

Each sand pan 30 is strategically located in the bottom of the vessel 12 in a sand settling area generally proximal the first end 14 of the vessel and over sand pan drains 34. Each sand pan drain 34 is fitted with a quick-opening full port sand withdrawal valve 36, such as a ball valve, to prevent sand bridging and/or plugging. Each sand withdrawal valve 36 must be opened periodically to start the flow of fluidized sand out of its respective sand pan 30.

Figure 4:
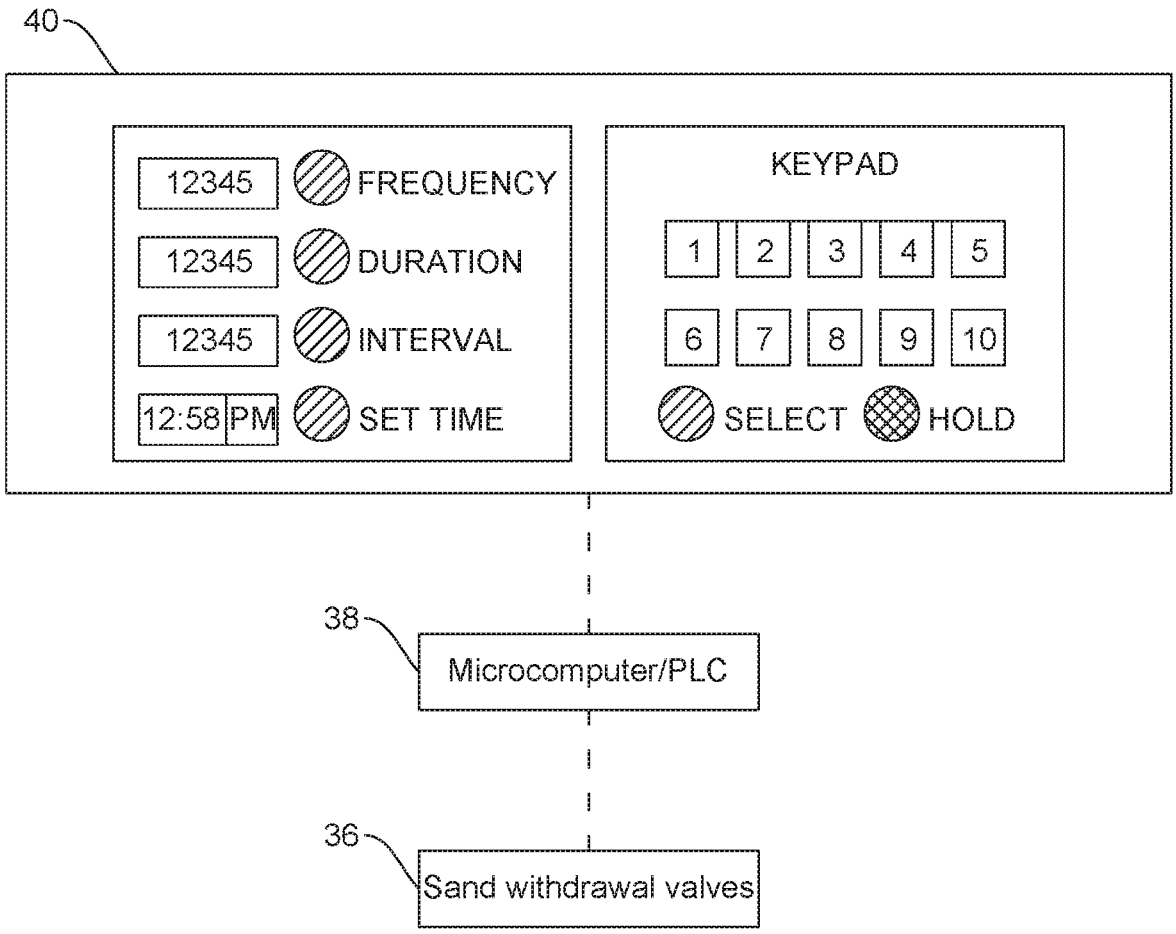
FIG. 4 is an exemplar of the automation and the communication flow of an exemplary communication system for automating the removal of sand from the sand pans.

The timing interval, duration, and frequency of the opening and closing of each sand pan valve 36 must be automated to assure the functional removal of sand. The automation comprises a micro-computer 38 or programmable logic controller (PLC) which uses a dedicated software algorithm to manage three operator-settable software timers (not shown) to assure that the accumulating sand is removed from the sand pans 30 as rapidly as it accumulates, thus preventing an over-accumulation of sand and sand withdrawal failure. The micro-computer or PLC 38 interfaces with a small LCD screen which displays the three operator-settable software timers and a time clock. The micro-computer or PLC 38 also interfaces with a touchpad 40. An exemplary touchpad 40 suitable for use in the present invention is shown in FIG. 4. In one embodiment of the invention, using the buttons on the touchpad 40, an operator can select and set 1) how often the sand withdrawal valves 36 sequentially open, 2) the number of seconds (dump duration) each sand withdrawal valve stays open, 3) the interval between the closing of one sand withdrawal valve and the opening of the next, and 4) the real time of day. To initiate a change, the operator will use the touchpad by pressing the "SELECT" software button on the touchpad 40. Then, the operator will select the function he wishes to alter on the left side of the display pad 40. The number key pad is used to enter the number of seconds for the desired function. Once the operator has entered the new values, he will press the "HOLD" button on the touchpad to lock the values until the next change. The mini-PLC software will accept the changes and operate the sand dump operation accordingly.

The paraffin control unit 10 may further comprise sand sample valves 42 for drawing samples from the fluid stream, a sand cleanout manway 44 providing access to the sand pans 30 and an access manway 46 for manual access to the vessel 12.

In order for the sand-free fluids to effectively divide into their discrete components, it is necessary to prevent paraffin precipitation from the crude oil. Otherwise, as the paraffin component precipitates, it nucleates around sand and water droplets, encapsulating them in a solid shell, and bringing the physical separation process for those particles and droplets to an immediate and perpetual halt. This defeats the process of discretely and efficiently dividing the fluids and solids. However, by preventing the precipitation of the otherwise soluble paraffin component of the crude oil, the division of components proceeds untethered, in a manner yet to be described.

Since all fluids flowing through the vessel 12 cone toward the center of the vessel due to friction losses occurring at and near the inner surface 22 of the vessel 12, periodic fluid redistribution of the commercially critical fluids, such as the crude oil and the natural gas, is necessary to maintain a higher degree of vessel utilization and process efficiency. Fluid redistribution occurs several times within the paraffin control unit 10 to assure a high degree of process efficiency. This redistribution is accomplished with one or more vertical plates, or redistribution baffles 50. The redistribution baffles 50 also absorb the momentum of instantaneous flow rate changes known as "slugs" or "heads", typical of production from high volume shale oil wells. Slugs and heads create a surge in fluid flows, which can create large flow waves inside the paraffin control unit 10. Such waves would tend to remix the sand and fluids, defeating the division of fluids and sand processes. The redistribution baffles 50 defeat the formation of waves, reflecting waves and dampening their effects on the downstream side of each redistribution baffle 50. The result is to create a quiescent environment where Stokes Law gravity separation can occur predictably.

Figure 5A:
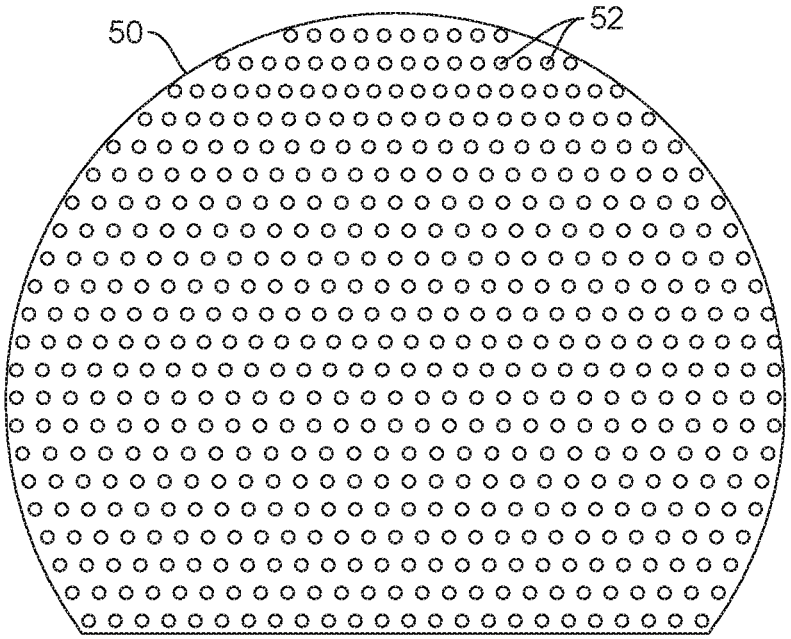
FIG. 5A is front view an exemplar of a redistribution baffle suitable for use in accordance with the paraffin control unit of the present invention.
Figure 5B:
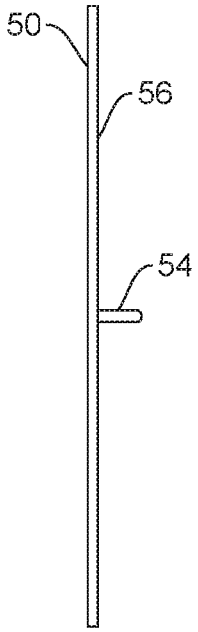
FIG. 5B is a side view of the redistribution baffle illustrated in FIG. 5A.

Turning now to FIG. 5, there is shown therein an exemplary baffle 50 suitable for use in the paraffin control unit 10 of the present invention. The number, shape, size and thickness of the redistribution baffles 50 generally correspond to the shape and size of the vessel 12. For example, when the vessel 12 is generally cylindrically shaped, the baffle 50 preferably will be generally round in order to conform to the shape of the vessel and facilitate secure connection to the vessel; provided, however, that fluids are permitted to flow and solids to collect underneath the baffle 24 in a manner yet to be described. The redistribution baffles 50 may be connected to the vessel 12 via welds or other suitable means for securing the redistribution baffles 50 to the vessel 12. The redistribution baffles 50 also may be integrally formed with the vessel 12. The thickness of the redistribution baffles 50 is variable and in one embodiment of the invention, the redistribution baffles are about inch thick. The redistribution baffles may be spaced approximately six to seven feet apart.

The redistribution baffles 50 may be made of any material suitable for use in processing solids and fluids, including steel, chrome, steel chrome-plated, steel with nickel/silicon carbide composite coating, brass, brass-chrome plated, brass with nickel/silicon carbide composite, stainless steel, stainless chrome-plated, copper, stainless with nickel/silicon carbide composite coating, carbonitrided steel, nickel carbide plated steel, tempered steel and polyvinylchloride. It will be appreciated that the redistribution baffles 50 may be produced from other materials suited to the particular temperatures, pressures, fluids, and other conditions of use.

Each redistribution baffle 50 contains a plurality of perforations 52 sufficient to facilitate redistribution of the fluids flowing through the paraffin control unit 10. The number and size of perforations in the redistribution baffles 50 depend upon a variety of factors, including operating temperatures, operating pressures, fluids to be processed, the size of the vessel 12, the application of the unit 10 and other conditions of use and conditions at the site where used. In one embodiment of the invention, the redistribution baffles 50 comprise a plurality of two-inch diameter circular perforations 52 equidistantly spaced approximately four inches apart on the baffle 50, as shown in FIG. 5. It will be appreciated that the number, size and location of the perforations 52 in the redistribution baffles 50 may comprise any size or shape and be configured on the redistribution baffles 50 in any relation that is suited to the particular temperatures, pressures, fluids, and other conditions of use of the paraffin control unit 10 at the particular site. The fluids are forced to redistribute across the perforations 52, thus augmenting separation.

Turning now to FIG. 5A, each of the redistribution baffles 50 may further comprise a strengthening member 54 on the backside 56 of each baffle 50. The strengthening member 54 extends horizontally from the backside 56 of each baffle 50 and is positioned in the center region of the backside of the baffle, or in the middle third of the height of backside of the baffle. The strengthening member 54 extends horizontally from the backside 56 of the baffle 50 a sufficient distance to impart strength to the baffle, and in one embodiment of the invention, the strengthening member has a length that extends approximately six inches from the backside of the baffle and is approximately ¾ inches thick and ¾ inches wide. The strengthening member 54 may be made from any material that imparts strength to the baffle 50 and may be made from the same material or different materials as the baffle 50. The strengthening member 54 may be integrally formed with the baffle 50 or may be secured to the baffle via welds, bolts, or other connection means.

In order for the sand-free fluids to effectively divide into their neat components, it is necessary to prevent paraffin precipitation from the crude oil. Otherwise, as the paraffin component precipitates it nucleates around sand and water droplets, encapsulating them in a solid shell, and bringing the physical separation process for those particles and droplets to an immediate and perpetual halt. This defeats the process of discretely and efficiently dividing the fluids and solids. However, by preventing the precipitation of the otherwise soluble paraffin component of the crude oil, the division of components proceeds untethered.

Returning now to FIGS. 1 and 2, the paraffin control unit 10 utilizes a series of high voltage electric immersion heaters 60 to generate heat and to transfer the heat directly into the crude oil stream in stages while maintaining paraffin in solution in the crude oil and returning precipitated paraffin to solution. The electric immersion heaters 60 are strategically located and staged at intervals sequentially between each baffle 50 to facilitate paraffin-free operation. Heat is transferred directly into the crude oil so that no heat is lost. The electric immersion heaters maintain the crude oil at the desired temperature above the cloud point of any paraffin constituent in the oil. This highly efficient heat transfer method provides superior heat transfer efficiencies over conventional heater treaters. Examples of electric immersion heaters suitable for use in the present invention include flanged, screw plug, over-the-side, and circulation immersion heaters. The voltage of the electric immersion heaters 60 ranges from about 0.5 kw to about 200 kw, and in one embodiment of the invention, the electric immersions heaters are 20 kw devices. The power and the number of interior heating elements of each electric immersion heater 60 will be determined by the size, location, application, qualities of the influent petroleum stream and other conditions at the site where the paraffin control unit 10 is to be employed. The electric immersion heaters 60 are sized and configured to correspond with the size and shape of the vessel 12. In one embodiment of the invention, the electric immersion heaters 60 are oblong in shape and extend approximately nine feet into the interior of the vessel 12.

Each electric immersion heater 60 is provided within a dedicated enclosure 62 made from stainless steel or other corrosion resistant material to protect the interior heating element (not shown) and which is mounted interiorly in the vessel 12 as shown, by way of example, in FIG. 2. The enclosure 62 separates the interior heating element of the electric immersion heater 60 from the incoming sand and fluid streams and increases the overall safety of the paraffin control unit 10. The electric immersion heater 60 may comprise terminal insulators and properly sized lugs and conduit openings for incoming wires.

The enclosure 62 also permits each interior heating element of each electric immersion heater 60 to be removed from its respective enclosure 62 without having to decommission the paraffin control unit 10. In the event that a given electric immersion heater 60 needs to be replaced, the replacement has no effect on the normal operation of the overall unit 10, eliminating otherwise costly non-processing downtime. One example of an electric immersion heater suitable for use in the paraffin control unit 10 of the present invention is manufactured by Chromolox.

Galvanic anodes 64 are positioned strategically throughout the paraffin control unit 10 so that the anodic material comprising the anode, such as magnesium, aluminum or zinc, corrodes in preference to the vessel 12 and the components comprising the paraffin control unit 10. One example of an anode 64 suitable for use in the paraffin control unit 10 is a 4"×60" ANSI 1150 flange mounted anode manufactured by Galvotec.

Figure 6A:
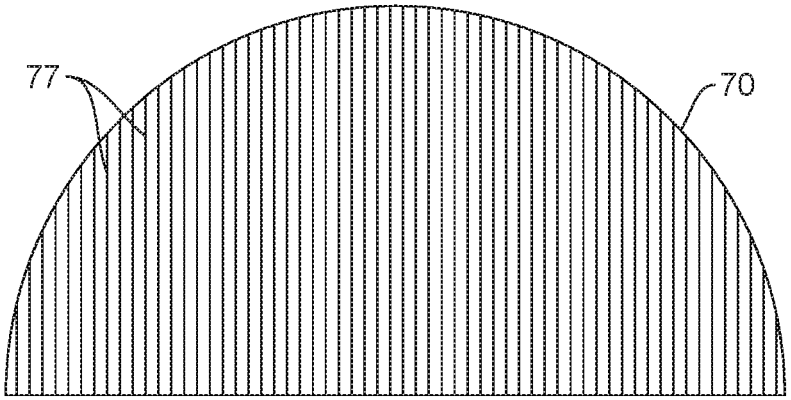
FIG. 6A is a front view of an exemplar of a vaned coalesce suitable for use in the paraffin control unit of the present invention.
Figure 6B:
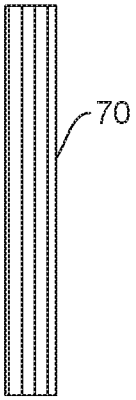
FIG. 6B is a side view of the vaned coalesce of FIG. 6A.
Figure 7A:
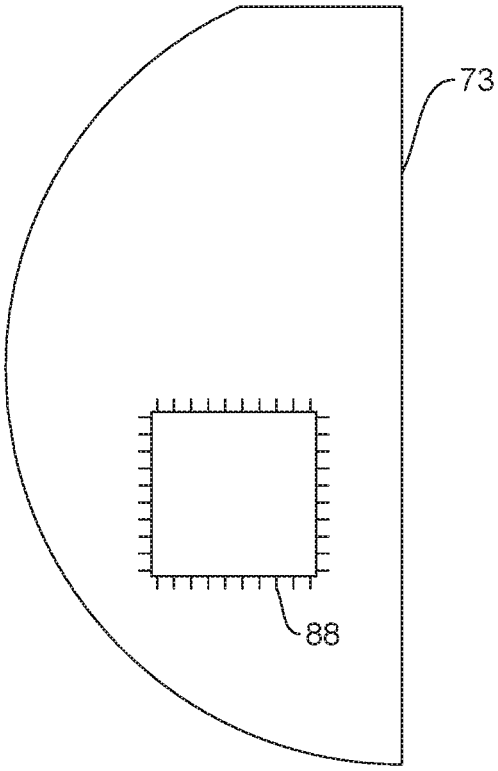
FIG. 7A is front view of a water chamber baffle comprising the baffle assembly suitable for use in the paraffin control unit of the present invention.
Figure 7B:
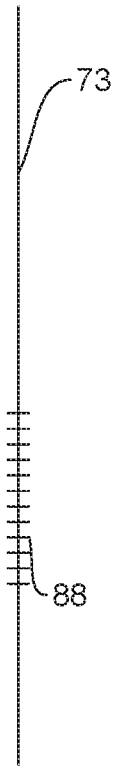
FIG. 7B is a side view of the water chamber baffle of FIG. 7A.
Figure 7C:
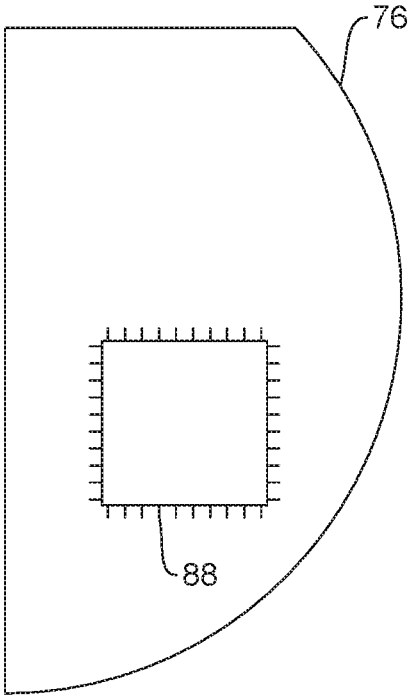
FIG. 7C is a front view of the oil spillover baffle comprising the baffle assembly suitable for use in the paraffin control unit of the present invention.
Figure 7D:
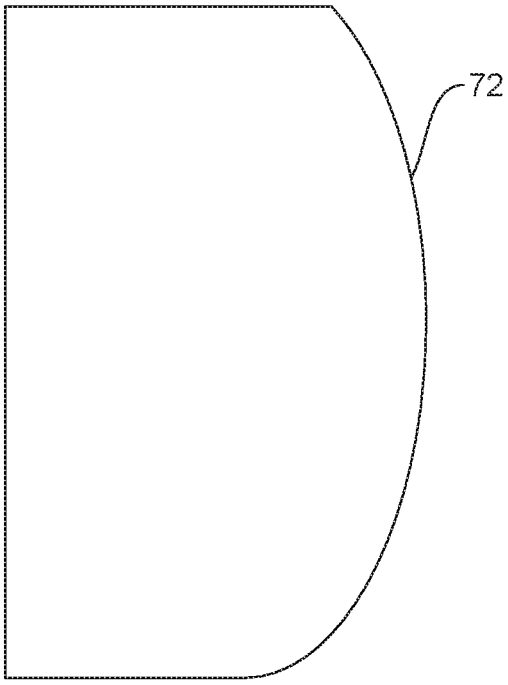
FIG. 7D is a side view of the divider baffle comprising the baffle assembly suitable for use in the paraffin control unit of the present invention.
Figure 7E:
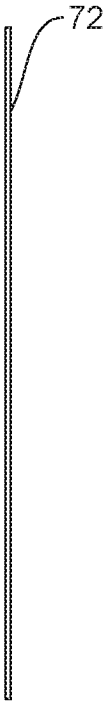
FIG. 7E is a front view of the divider baffle of FIG. 7D.

Turning now to FIG. 6, and with continuing reference to FIGS. 1 and 2, as the fluids approach the outlet end 16 of the paraffin control unit 10 the influent petroleum stream has separated, with the gas layer at the top and the oil liquid layer underneath the gas layer, each phase flows through a chevron-style vaned coalescer 70 positioned against the upper inner surface 22 of the vessel 10 proximal the outlet end 16. It will be appreciated that the gas layer may still comprise water or oil, and the oil layer may still comprise water or gas, and the water layer may still comprise gas or oil. The vaned coalescer 70 removes liquid droplets larger than 6 microns from the gas stream, and water droplets larger than 30 microns from the crude oil stream, effectively "polishing" these streams to the desired purity, suitable for custody transfer of both the crude oil and the natural gas. As the stream of gas and fluid mixture enters vaned coalescer 70, the mixture is forced to change directions several times as it proceeds toward the outlet end 16. The gas, which is lower in density, more easily navigates the change in direction caused by the vanes 77, but the higher density liquid is unable to change direction without impinging on the vanes, causing liquid particles coalesce into larger particles and descend and blend into the oil and water phases. The paraffin control unit 10 of the present invention may employ more than one vaned coalescer 70 in immediate succession, as shown in FIG. 6B, or spaced apart. The vaned coalescer 70 may be semi-circular in shape and sized to fit the dimension of the vessel 12.

The vaned coalescer 70 extends downward from the top inner surface of the vessel 10, through the gas layer and down into the oil layer. As the gas layer flows through the vane coalescer 70, the gas is demisted, thereby recovering valuable liquid oil mist droplets which drain into the oil phase below the gas layer. The demisted gas layer is then removed via the gas outlet 71 at the top of the primary separation compartment of the vessel. The exiting gas may be sold, compressed, further processed or flared.

Turning now to FIGS. 7A, 7B, 7C, 7D and 7E, a spillover baffle assembly 81 positioned proximal the outlet end 16 comprises a divider baffle 72, a water chamber isolation baffle 73 and an oil spillover baffle 76. An interface adjuster 74 adjusts the oil-water interface according to the density of the fluids in the vessel 12. The oil phase fills up in the vessel 12 to the level set by the interface adjuster 74 and flows over the oil spillover baffle 76 into the oil chamber 78 created by the divider baffle 72. Upon passing through the vaned coalescer 70, the resulting dehydrated crude oil joins the oil phase in the oil chamber 78 and exits the vessel through the oil outlet 80. Paraffin remains in solution in the oil due to the staged presence of the electric immersion heating elements 60 and positioned throughout the vessel 12, including at least one electric immersion heating element positioned downstream of the vaned coalescer 70. The size and shape of the baffles comprising the baffle assembly 81 generally correspond to the size and shape of the vessel 12. In one embodiment of the invention, where the vessel 12 is generally cylindrical in shape, the baffles of the baffle assembly 81 are generally semi-circular in shape; however, the respective height of each baffle varies to facilitate the separation of fluids in the petroleum stream. In one embodiment of the baffle assembly, the divider baffle 72 is about nine feet three inches in height and has a width of about 5.5 feet. The water chamber isolation baffle 73 measures about nine feet three inches in height and about 5.5 feet in width. The oil spillover baffle 76 is about eight feet two inches in height and about 5.5 feet in width.

As the oil phase is heated, its viscosity is reduced allowing the heavier water that may be entrained within the oil to fall more rapidly to the bottom of the vessel 12, thereby forming a water phase below the oil phase. Additionally, the water removed by the vaned coalescer 70 falls to the water phase at the bottom the vessel 12. The water phase flows through the grooved coupling 86 and up the water leg 82 into the water chamber 90 for removal from the vessel 12 at the water outlet 92.

Coating accesses 88 in the water chamber isolation baffle 73 and an oil spillover baffle 76 permit coating of the redistribution baffles 60, the divider baffle 72, the oil chamber 78, the water leg 82, the grooved coupling 86 and the water chamber 90 and other internal components of the paraffin control unit 10, in order to help prevent corrosion. Coating accesses 88 have covers (not shown) which are secured to the water chamber isolation baffle 73 and the oil spillover baffle 76.

The paraffin control unit 10 may further comprise a relief valve 100, drains 102, gauge glass connections 104, a low emergency shut down 106, a high emergency shutdown 108, and oil chamber LLC 110, a water chamber LLC 112, pressure gauges 114 and instrument gas 116.

Example

The efficiency of a paraffin control unit constructed in accordance with the present invention is demonstrated by the following example. A heater treater processing 500 BOPD at 75° Fahrenheit (F) is heated with produced gas. This example assumes produced gas is worth US$4.00/MCF and that a typical fire tube heater treater has a thermal efficiency of 18%, which is generous. It is known that 150 BTU/° F. are required to heat one barrel of oil.

150 BTU/° F. per barrel×500 BOPD=5.625.000 BTU/day

Thermal Efficiency Calculation for a Paraffin Control Unit of the Present Invention Using Electric Immersion Heaters:

5,625,000 BTU/day÷1,000 BTU/SCF=5,625 SCF/day 5.625 SCF/day÷1.000 SCF/MCF=5.625 MCF/day at 100% thermal efficiency Thermal Efficiency Calculation for a Conventional Heater Treater Using Fire Tubes:

5.625 MCF/day÷18% thermal efficiency=31.25 MCF/day 31.25 MCF/day×$US4.00/MCF=$125/day in fuel gas costs Over the course of one year, the average fuel gas cost for this well producing 150 BOPD would be US$45,625 at the rate of UD$4.00/MCF. Scaled up, where the heater treater is processing crude from more than one well, these fuel costs multiply. For example, when processing production from 200 wells each producing 500 BOPD, the fuel gas costs escalate to US$9.125.000 per year. Thus, in this example, the paraffin control unit 10 of the present invention would realize savings of close to one million dollars per year.

The method and operation of the invention will now be explained. The foregoing description of the invention is incorporated herein. The influent stream, comprising fluids and solids, entering the paraffin control unit 10 first encounter an inlet diverter 20. The inlet diverter 20 divides the influent stream into components, slows the velocity of each divided component of the influent stream, and directs each component toward the inner surface 22 of the vessel 12. The diverter 20 acts as a coalescer to enhance flow division and to enhance the overall separation process. The paraffin control unit 10 of the present invention overcomes this problem by efficiently removing solids, including sand, as they accumulate. Separation of solids from fluids is rapid and predictable since the density of sand is several times heavier than the densities of the associated fluids in the influent petroleum stream. Sands, being heavier than liquids and natural gas, naturally settle rapidly to the bottom of the paraffin control unit 10, as the sand settles, it accumulates around dedicated sand removal fixtures, or sand pans 30.

The influent flow through inlet diverter 20 often contains solids, such as sands which must be removed from the fluid streams or these solids will accumulate inside the vessel and in all process and fluid storage surface facilities, ultimately rendering them ineffective.

The paraffin control unit 10 of the present invention efficiently removes solids, including sand, as they accumulate. Separation of solids from fluids is rapid and predictable since the density of sand is several times heavier than that of the associated fluids in the influent stream. Sands, being heavier than liquids and natural gas, naturally settle rapidly to the bottom of the paraffin control unit 10. The settling rate is predictable using Stokes' Law.

As the sand settles, it accumulates around sand pans 30 which fluidize the consolidated sand layer allowing it to flow as a fluid. Each sand pan 30 is strategically located in the bottom of the vessel 12 in a sand settling area generally proximal the first end 14 of the vessel and over sand pan drains 34 and is fitted with a quick-opening full port sand withdrawal valve 36. Each sand withdrawal valve 36 must be opened periodically to start the flow of fluidized sand out of its respective sand pan 30.

The timing interval, duration, and frequency of the opening and closing of each sand pan valve 36 must be automated to assure the functional removal of sand. The automation comprises a micro-computer 38 which uses a dedicated software algorithm to manage three operator-settable software timers (not shown) to assure that the accumulating sand is removed from the sand pans 30 as rapidly as it accumulates, thus preventing an over-accumulation of sand and sand withdrawal failure. The micro-computer or PLC 38 interfaces with a small LCD screen which displays the three operator-settable software timers and a time clock. The micro-computer or PLC 38 also interfaces with a touchpad 40. An exemplary touchpad 40 suitable for use in the present invention is shown in FIG. 4. In one embodiment of the invention, using the buttons on the touchpad 40, an operator can select and set 1) how often the sand withdrawal valves 36 sequentially open, 2) the number of seconds (dump duration) each sand withdrawal valve stays open, 3) the interval between the closing of one sand withdrawal valve and the opening of the next, and 4) the real time of day. To initiate a change, the operator will use the touchpad by pressing the "SELECT" software button on the touchpad 40. Then, he will select the function he wishes to alter on the left side of the display pad 40. The number key pad is used to enter the number of seconds for the desired function. Once the operator has entered the new values, he will press the "HOLD" button on the touchpad to lock the values until the next change. The mini-PLC software will accept the changes and operate the sand dump operation accordingly.

Since all fluids flowing through the vessel 12 cone toward the center of the vessel due to friction losses occurring at and near the inner surface 22 of the vessel 12, periodic fluid redistribution of the commercially critical fluids, such as the crude oil and the natural gas, is necessary to maintain a higher degree of vessel utilization and process efficiency. Fluid redistribution occurs several times within the paraffin control unit 10 to assure a high degree of process efficiency. This redistribution is accomplished with one or more vertical plates, or redistribution baffles, 50. The redistribution baffles 50 also absorb the momentum of instantaneous flow rate changes known as "slugs" or "heads", typical of production from high volume shale oil wells. Slugs and heads create a surge in fluid flows, which can create large flow waves inside the paraffin control unit 10. Such waves would tend to remix the sand and fluids, defeating the division of fluids and sand processes. The redistribution baffles 50 defeat the formation of waves, reflecting waves and dampening their effects on the downstream side of each redistribution baffle 50. The result is to create a quiescent environment where Stokes Law gravity separation can occur predictably.

In order for the sand-free fluids to effectively divide into their neat components it is necessary to prevent paraffin precipitation from the crude oil. Otherwise, as the paraffin component precipitates it nucleates around sand and water droplets, encapsulating them in a solid shell, and bringing the physical separation process for those particles and droplets to an immediate and perpetual halt. This defeats the process of discretely and efficiently dividing the fluids and solids. However, by preventing the precipitation of the otherwise soluble paraffin component of the crude oil, the division of components proceeds untethered.

The paraffin control unit 10 utilizes a series of high voltage electric immersion heaters 60 to generate heat and to transfer the heat directly into the crude oil stream in stages while maintaining paraffin in solution in the crude oil. The electric immersion heaters 60 are strategically located and staged between each baffle 50 to facilitate paraffin-free operation. Heat is transferred directly into the crude oil so that no heat is lost. This highly efficient heat transfer method provides superior heat transfer efficiencies over conventional heater treaters. As the fluids approach the outlet end 16 of the paraffin control unit 10, with the gas layer at the top and the liquid layer underneath the gas layer, each phase flows through a chevron-style vaned coalescer 70 positioned against the upper inner surface 22 of the vessel 10 proximal the outlet end 16. The vaned coalescer 70 removes liquid droplets larger than 6 microns from the gas stream, and water droplets larger than 30 microns from the crude oil stream, effectively "polishing" these streams to the desired purity, suitable for custody transfer of both the crude oil and the natural gas. As the stream of gas and fluid mixture enters vaned coalesce 70, the mixture is forced to change directions several times as it proceeds toward the outlet end 16. The gas, which is lower in density, more easily navigates the change in direction caused by the vanes 77, but the higher density liquid is unable to change direction without impinging on the vanes, causing liquid particles coalesce into larger particles and descend and blend into the oil and water phases. As the gas layer flows through the vane coalescer 70, the gas is demisted, thereby recovering valuable liquid oil mist droplets which drain into the oil phase below the gas layer. The demisted gas layer is then removed via the gas outlet 71 at the top of the primary separation compartment of the vessel. The exiting gas may be sold, compressed, further processed or flared.

An interface adjuster 74 adjusts the oil-water interface according to the density of the fluids in the vessel 12. The oil phase fills up to the level set by the interface adjuster 74 and flows over the oil spillover baffle 76 into the oil chamber 78 created by the divider baffle 72. Upon passing through the vaned coalescer 70, the resulting dehydrated crude oil joins the oil phase in the oil chamber 78 and exits the vessel through the oil outlet 80. Paraffin remains in solution in the oil due to the staged presence of the electric immersion heating elements 60 and positioned throughout the vessel 12, including at least one electric immersion heating element positioned downstream of the vaned coalescer 70.

As the oil phase is heated, its viscosity is reduced, which allows the heavier water that may be entrained within the oil to fall more rapidly to the bottom of the vessel 12, thereby forming a water phase below the oil phase. Additionally, the water removed by the vaned coalescer 70 falls by gravity to the water phase at the bottom the vessel 12. The water phase flows from the bottom of the vessel, through the grooved coupling 86 and up the water leg 82 into the water chamber 90 for removal from the vessel 12 at the water outlet 92.

The invention has been described above both generically and with regard to specific embodiments. Although the invention has been set forth in what has been believed to be preferred embodiments, a wide variety of alternatives known to those of skill in the art can be selected with a generic disclosure. Changes may be made in the combination and arrangement of the various parts, elements, steps and procedures described herein without departing from the spirit and scope of the invention as defined in the following claims.

I claim:

1. A method for processing a petroleum stream, the method comprising the steps of:

receiving an influent petroleum stream;

dividing the influent petroleum stream into a gas phase, an oil phase and a solid phase;

transmitting electric heat energy directly into the oil phase at staged intervals as the influent petroleum stream is processed; and maintaining the temperature of the oil phase above the cloud point of any paraffin wax constituent that may be present in the influent petroleum stream.

2. The method of claim 1 wherein the step of dividing the influent petroleum stream into a gas phase, an oil phase and a solid phase is accomplished via an inlet diverter.

3. The method of claim 1 further comprising the step of redistributing the oil phase and the gas phase through one or more redistribution baffles.

4. The method of claim 3 wherein the step of redistributing the oil phase and the gas phase through one or more redistribution baffles is performed repeatedly and is performed alternately with the step of transmitting electric heat energy directly into the oil phase at staged intervals as the influent petroleum stream is processed.

5. The method of claim 4 further comprising the step of removing the gas phase.

6. The method of claim 4 further comprising the step of removing the oil phase.

7. The method of claim 1 further comprising the step of purifying the gas phase and the oil phase through a vaned coalescer.

8. The method of claim 7 further comprising the step of separating the gas phase from the oil phase for sale or delivery.

* * * * *